United States Patent [19]

Andreoli

[11] Patent Number: 4,802,352

[45] Date of Patent: Feb. 7, 1989

[54] DOUBLE-THROW BAR LOCK HAVING INDEPENDENTLY OPERABLE CYLINDERS

[75] Inventor: Gian P. Andreoli, Artogne, Italy

[73] Assignee: ISEO Serrrature SPA, Pisogne, Italy

[21] Appl. No.: 59,499

[22] Filed: Jun. 8, 1987

[30] Foreign Application Priority Data

Jul. 25, 1986 [IT] Italy ..... 21526 A/86

[51] Int. Cl.[4] ..... E05B 17/04

[52] U.S. Cl. ..... 70/118; 70/120; 70/379 R; 70/386; 70/DIG. 60

[58] Field of Search ..... 70/386, 113, 118–120, 70/379 R, 379 A, 380, 372, DIG. 60, DIG. 9, DIG. 42; 292/252

[56] References Cited

U.S. PATENT DOCUMENTS

| | | | |
|---|---|---|---|
| 78,449 | 6/1868 | Gibbs | 70/120 |
| 387,523 | 8/1888 | Loch | 70/DIG. 42 X |
| 1,505,865 | 8/1924 | Costa | 70/120 |
| 2,177,996 | 10/1939 | Raymond | 70/386 |
| 2,620,648 | 12/1952 | Quigley | 70/379 R |
| 3,500,670 | 3/1970 | Hawkins | 70/386 |
| 3,531,959 | 10/1970 | Weber | 70/386 |
| 3,659,444 | 5/1972 | Wellekens | 70/386 |
| 3,848,442 | 11/1974 | Mertanen | 70/372 X |
| 4,195,503 | 4/1980 | Roberts | 70/372 X |
| 4,300,374 | 11/1981 | Mullich et al. | 70/DIG. 42 X |

FOREIGN PATENT DOCUMENTS

| | | | |
|---|---|---|---|
| 515779 | 12/1952 | Belgium | 70/118 |
| 26255 | 12/1953 | Finland | 70/379 R |
| 563644 | 9/1923 | France | 70/379 R |
| 772596 | 8/1934 | France | 70/380 |
| 520589 | 3/1955 | Italy | 70/120 |
| 222030 | 8/1968 | Sweden | 70/380 |

*Primary Examiner*—Lloyd A. Gall

*Attorney, Agent, or Firm*—Parkhurst, Oliff & Berridge

[57] ABSTRACT

A bar lock comprising two toothed plates (1) and (2) and a rotatable cross element (3) which transmits movement to said plates. The cross element (3) is operated by two mechanisms, one internal and one external, which act independently of each other; the internal mechanism is composed of elements which are specular to the elements of the external mechanism. Each of said mechanisms comprises the following elements: a recess (25) provided in the base plate (18) and in the counter-plate (12) respectively; a rotary element (5) rotatable within said recess, the rotary element having a seat for entraining a roller (6) and having engagement means for engaging a tang of a cylinder or knob; a disc (7) rotatable with the cross element (3) and having notches (26) and (27); a slider (9) maintained in contact with the cross element by a spring (10) fixed to a spring-guide block (14). The toothed plates (1) and (2) are operated when the roller (6) engages in one of the notches (26) and (27) to make the rotatable circular element (5) rotatable with the disc (7), such that the cross element (3) is rotated by rotation of the cylinder or knob.

9 Claims, 5 Drawing Sheets

DOUBLE-THROW BAR LOCK HAVING INDEPENDENTLY OPERABLE CYLINDERS

FIELD OF THE INVENTION

This invention relates to a double-throw bar lock having conventional cylinders which can be operated independently from the inside and from the outside, for example, of a door. More particularly, the invention relates to a bar lock with its mechanism operated by two cylinders, one internal and one external, which act independently of each other so that when one is operated the other remains at rest, the characteristics of the mechanism being such that the bars undergo their complete travel by means of two key revolutions.

BACKGROUND OF THE INVENTION

An advantage of the bar lock according to the present invention is that said cylinders are of conventional type used in normal locks, and are readily available commercially.

In this respect, bar locks are currently known which operate with a cylinder provided with a specially constructed gear wheel.

These bar locks consist essentially of two toothed plates engaging said gear wheel which when rotated causes the two plates to advance or retract, to thus close or open the door respectively. This type of bar lock has the serious drawback of operating only with a special type of cylinder which is difficult to obtain and replace if faulty.

SUMMARY OF THE INVENTION

In accordance with the present invention, we have now discovered a new type of bar lock using conventional cylinders which operate the lock mechanism by means of tangs fitted to the cylinders. That cylinder which is applied internally can be replaced by, e.g., a doorknob without the lock requiring any modification.

The bar lock according to the present invention comprises: an external cylinder having a tang and an internal cylinder or knob having a tang two toothed plates;

a rotatable cross element which, when rotated, transmits movement to said plates.

The cross element is rotatable by two identical mechanisms, one of which, called hereinafter the internal mechanism, is for operation from the inside and the other of which, called hereinafter the external mechanism, is for operation from the outside.

The internal mechanism is composed of elements which are specular to the elements of the external mechanism.

Each of said mechanisms comprises the following elements:

a recess provided in the base plate and in the counterplate respectively;

a rotary element which is rotatable within said recess the rotary element having a seat for entraining a cylindrical roller and engagement means for engaging the tang of the cylinder or knob;

a disc with notches, the disc being engaged with said rotary element when said roller is in one of said notches, the disc being fixed to said cross element so as to be rotatable therewith;

a slider maintained in contact with the cross element.

DESCRIPTION OF THE PREFERRED EMBODIMENTS

Figures 1, 2:
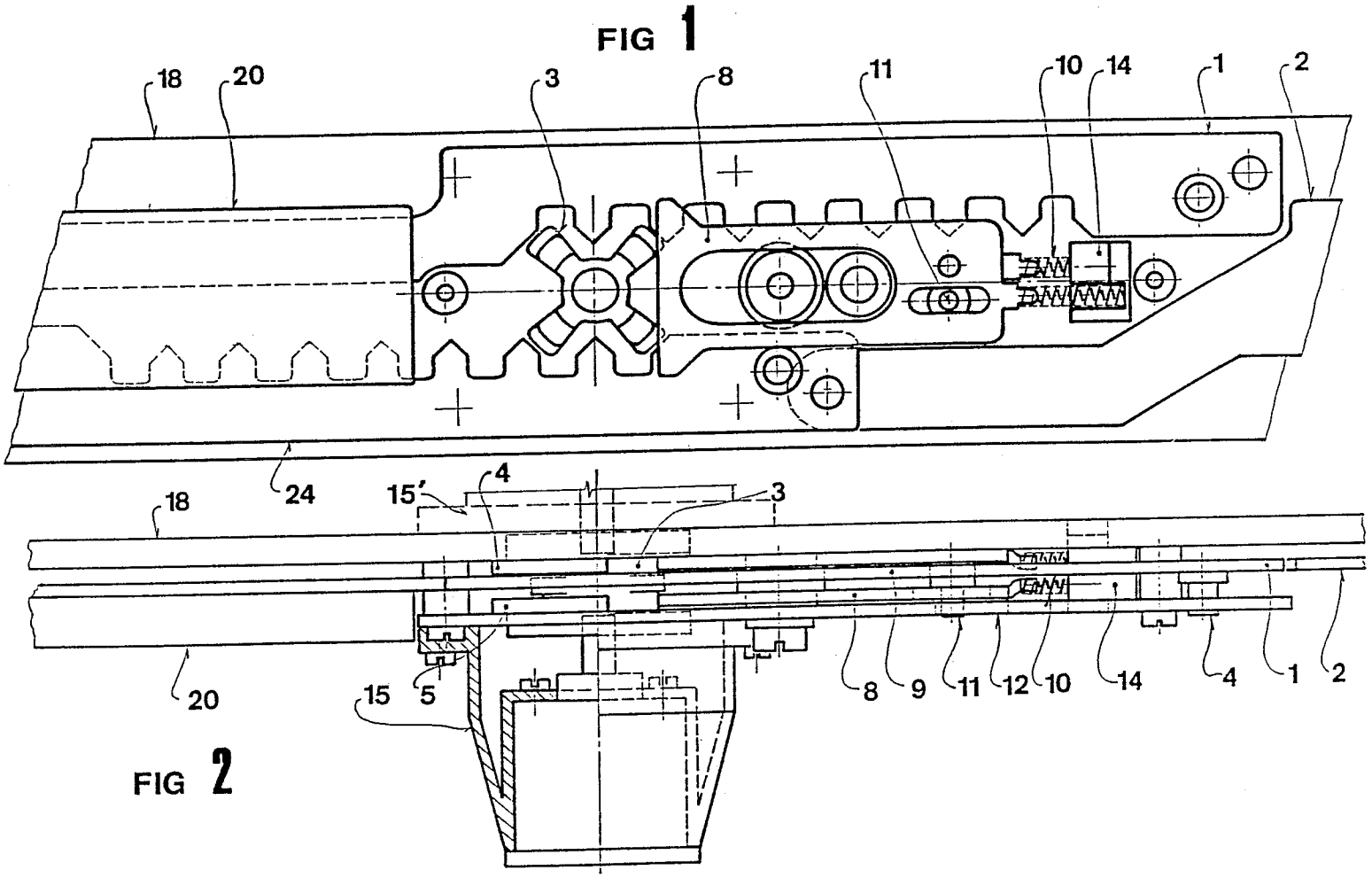
FIG. 1 is a front perspective view of a lock in accordance with the present invention.
FIG. 2 is a top view of the lock shown in FIG. 1.
Figure 3:
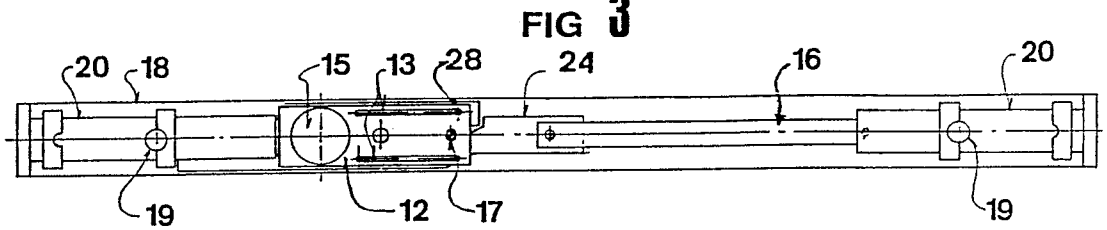
FIGS. 3–8 illustrate a cover for the lock and means for preventing removal of the cover when the lock is locked.
Figure 4:
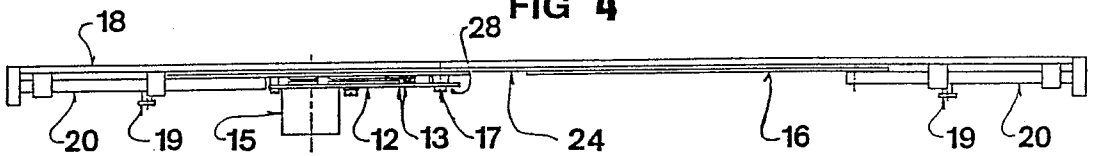
Figure 8:
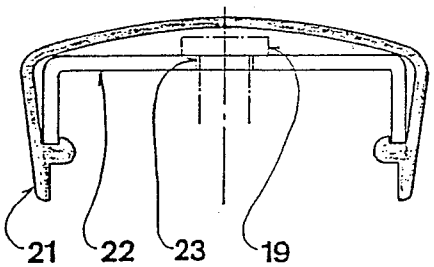
Figure 7:
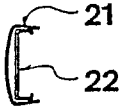
Figure 5:
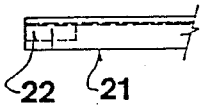
Figure 6:
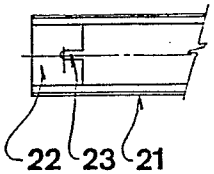

These and further characteristics and advantages of the bar lock according to the invention will be more apparent from the detailed description given hereinafter with reference to the Figures, which relate to preferred embodiments of the invention and are provided for non-limiting illustration only.

The reference numeral 18 indicates the base plate of the bar lock according to the invention which, in one embodiment, comprises two cylinders, one internal and one external, indicated by 15 and 15'.

Figure 14:
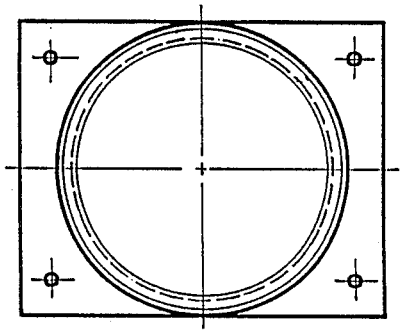
FIGS. 14 and 15 are front and top views, respectively, of an internal knob.
Figure 15:
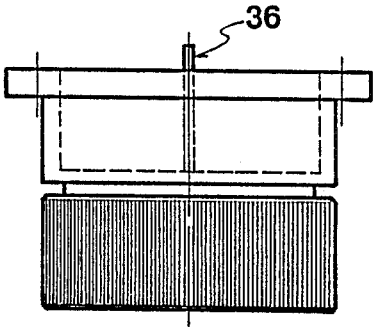
Figure 16:
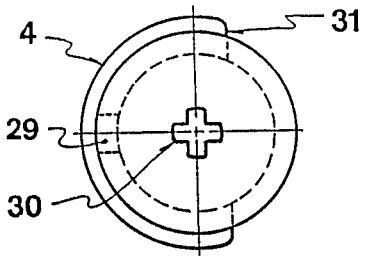
FIGS. 16 and 17 are front and side views, respectively, of a rotary element.

An alternative embodiment comprises an external cylinder and an internal knob which can be replaced by the internal cylinder when required. Said knob is constructed for example as shown in FIGS. 14 and 15, in which the fitted tang is indicated by 36.

A counter-plate 12, which is fixed to the base plate 18 by a screw 17, comprises a recess 25 divided into two sectors:

a smaller diameter sector comprising an arc corresponding to an angle of 270°;

a larger diameter sector comprising an arc corresponding to an angle of 90°, it being smoothly joined to the first sector and defining a so-called dead region.

Figure 17:
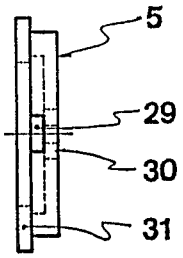

As shown in FIG. 17, a rotary element 5, rotatable within the recess 25, has a raised conformation 31 along part of its circumference, and within its depth there is provided the seat 29 for entraining a cylindrical roller 6. The same element comprises in a central position two slots disposed in the form of a cross 30, with which the internal cylinder or knob tangs engage. A similar rotary element 4 is provided for engagement with tongs of the external cylinder or knob.

Figure 9:
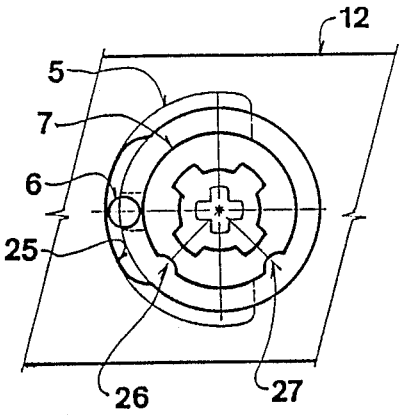
FIGS. 9–13 illustrate the positions occupied by a counter plate, a rotary element, a disc and a cylindrical roller in accordance with the present invention during a lock operation cycle.
Figure 10:
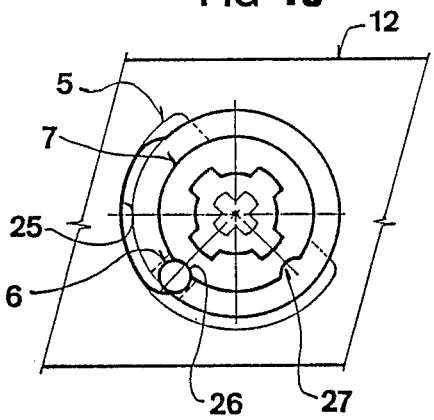
Figure 18:
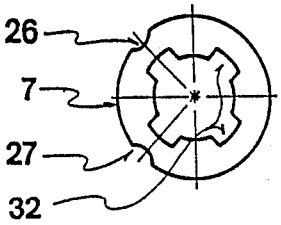
FIGS. 18 and 19 are front and side views, respectively, of a disc.
Figure 19:
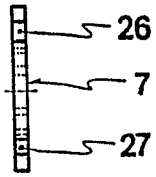

Discs 7 are provided on either side of the cross element 3. Referring to FIGS. 9 and 18, each of the discs 7 is provided in an outer circumference with two semicircular notches 26 and 27; said notches are disposed at the ends of an arc corresponding to an angle of 90°.

The notches 26 and 27 of the discs 7 angularly correspond to one another.

Figure 21:
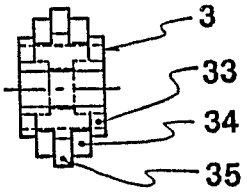
FIGS. 20 and 21 are front and side views, respectively, of a cross element.
Figure 20:
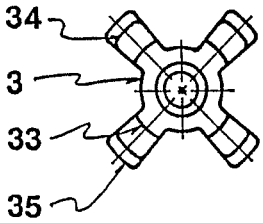

For constructional reasons the discs can initially be separate from the cross element 3, but in the completed lock are rigid therewith and conceptually form a single piece therewith; they are mounted on the cross element 3 by means of the indentations 32 in an internal circumference of each of the discs 7, the indentations provided for corresponding with teeth 33 provided on the cross element (see FIG. 21).

The cross element 3 occupies the central part of the mechanism and is provided with four teeth comprising steps 34, two of which are in contact with a surface of each of a first slider 8 and a second slider 9 when the cross element 3 is not being rotated.

The central part 35 engages with the teeth of first and second toothed plates 1 and 2.

The operation of the bar lock according to the present invention is as follows: on turning the key, the tang fitted to the cylinder or knob, for example the tang 36, is rotated; the tang engages cross-shaped aperture 30 and causes the rotary element 5 to rotate. When the roller 6 is engaged with one of the two notches 26 or 27, the rotatable circular element 5 is rigid with the disc 7, thereby causing the cross element 3 to rotate, which causes the toothed plates 1 and 2 to move along parallel but mutually opposite directions.

The movement of the toothed plates is guided by a system consisting of pins 28 fixed to the plates, and slots 13 provided in the counter-plate 12.

A bar 20 is fixed to each of said toothed plates 1 and 2 either directly or by means of connection plates 16, and engages in an element which may be provided in the doorpost to hold the door in a closed position.

As shown in FIGS. 9 to 13, the lock operation cycle comprises the following stages:

Stage 1—From initiation to completion of the first key revolution:

In the initiation position, the roller 6 is positioned in the dead region defined by the counter plate 12 (FIG. 9). From this position, on rotating the rotary element 5 anticlockwise, the roller 6 can move within the dead region without influencing the disc 7 until the end of the dead region.

At this point, the roller is obliged to enter the notch 26 (FIG. 10), thereby making the disc 7 and thus the cross element 3 rigid with the rotary element 5. In this manner, movement is transmitted to the toothed plates 1 and 2.

Figure 11:
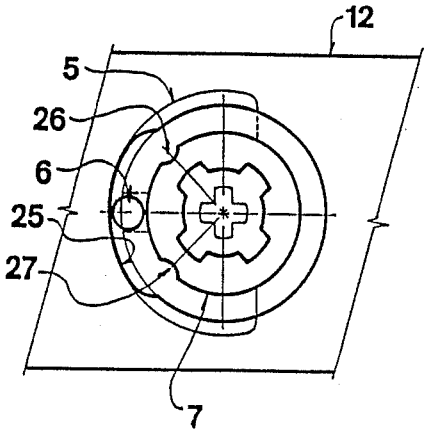
Figure 12:
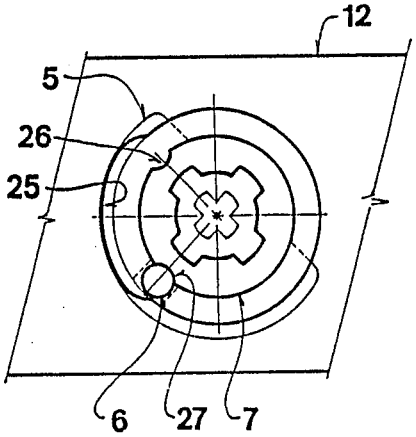

As turning continues, the roller 6 remains engaged in the notch 26 for a rotation of 270° until it again reaches the dead region, where it emerges from the notch 26, so that the disc 7 is no longer rigid with the rotary element 5 and remains at rest while the roller 6 passes through the dead region (FIG. 11). While the roller 6 passes through the dead region, the toothed plates remain at rest. Thus, whereas the rotary element 5 rotates through 360°, the disc 7 rotates through 270°.

Stage 2—From the end of the first to the end of the second key revolution:

When the roller 6 reaches the end of the dead region, it is obliged on continuation of rotation to enter the notch 27 (FIG. 12), thereby making the disc 7 and thus the cross element 3 rigid with the rotary element 5, with the result that movement of the toothed plates is resumed.

As turning continues, the roller 6 remains engaged in the notch 27 for a rotation of 270°, ie until it again reaches the dead region, where it leaves the notch 27 so that the disc 7 is no longer rigid with the rotary element 5, and the plates remain at rest.

Figure 13:
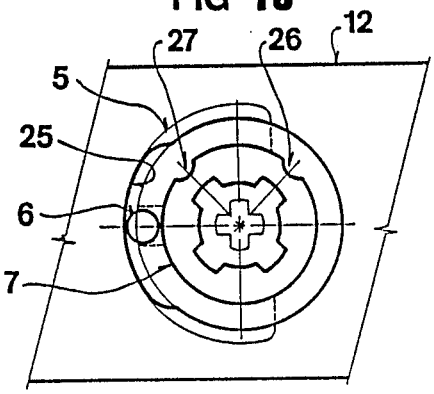

Again in this case, whereas the rotary element 5 rotates through 360°, the disc 7 rotates through 270° (FIG. 13).

Thus with the completion of stages 1 and 2, the bars 20 have undergone their complete travel.

Because of the presence of the dead region, the external cylinder can remain stationary when the internal cylinder is operated, and vice versa.

The purpose of the two sliders 8 and 9 is to keep the cross element 3 stationary until the roller 6 has entered one of the notches 26 and 27.

As shown in FIG. 1 for the first slider 8, the sliders are maintained in contact with steps 34 of the cross element 3 by means of the springs 10 contained in a spring-guide block 14.

The slider concerned is moved against the spring by the respective rotary element 5 by means of the raised conformation 31, and in the meantime the other slider keeps the cross element at rest until the roller 6 has entered the respective notch. This is necessary because if the notch is not maintained in an exact position at the end of the dead region, the roller is unable to enter it. When the roller 6 enters one of the notches, the first slider entrains the second by means of a pin 11 which engages the relative slot, to release the cross element 3, thereby allowing the cross element to rotate.

A further characteristic of the bar lock according to the present invention shown in FIGS. 3 to 8 is that two mushroom-shaped elements 19 fixed to the bars 20 engage, during locking, with slots 23 in two plates 22 fitted to the inside of the cover 21, so preventing the removal of the cover 21 when the lock is in its locked state.

I claim:

1. A double-throw bar lock operable independently from opposite sides, the lock comprising an external cylinder having a tang and an internal cylinder or knob having a tang, two toothed plates and a rotatable cross element which, when rotated, transmits movement to said plates, said cross element being rotatable by an internal mechanism, provided for operation from a first side of the lock and an external mechanism, provided for operation from a second side of the lock, each of said mechanisms comprising:

a base plate or a counter-plate, respectively;

a recess provided in the base plate and in the counter-plate, said recess having a smaller diameter sector and a larger diameter sector, the sectors being smoothly joined, the larger diameter sector defining a dead region;

a rotary element rotatable within said recess, said rotary element having a raised conformation along part of an outer circumference, a seat being provided in said rotary element for entraining a cylindrical roller, the rotary element having engagement means for engaging the tangs of the external cylinder or the internal cylinder or knob;

a disc rigid with the cross element and having notches, the notches of the disc in the internal mechanism being angularly aligned with the notches of the disc in the external mechanism;

a slider; and a pressure means for maintaining the slider in contact with the cross element;

whereby when said roller is positioned in one of said notches, the rotary element and the disc rotate together and when said roller is positioned in said dead region, the rotary element is free to rotate independently of the disc.

2. A bar lock as claimed in claim 1, wherein said smaller diameter sector comprises an arc corresponding to an angle of about 270° and said larger diameter sector comprises an arc corresponding to an angle of about 90°.

3. A bar lock as claimed in claim 1, wherein said notches are disposed at the ends of an arc corresponding to an angle of 90°.

4. A bar lock as claimed in claim 1, wherein said cross element is provided with four teeth having recesses which contact each of the sliders.

5. A bar lock as claimed in claim 1, wherein said roller engages with one of said notches when in the smaller diameter sector of said recess to cause said rotary element to rotate with the disc to thus transmit rotation to the cross element, thereby causing movement of the toothed plates.

6. A bar lock as claimed in claim 1, wherein said roller is disengaged from the notches when in the larger diameter sector of said recess, such that movement is not transmitted to the toothed plates.

7. A bar lock as claimed in claim 1, wherein said slider restrains the cross element from movement until the roller enters one of the notches.

8. A bar lock as claimed in claim 1, wherein a bar is fixed to each of said toothed plates either directly or by means of connection plates, said bar selectively engaging a doorpost element.

9. A bar lock as claimed in claim 8, further comprising a cover, two cover plates, and two mushroom-shaped elements fixed to the bars which engage, during locking, with slots in the two cover plates, the cover plates being fitted to the inside of the cover, thereby preventing removal of said cover when the lock is in its locked state.

* * * * *